US010745869B2

(12) United States Patent
Berning et al.

(10) Patent No.: US 10,745,869 B2
(45) **Date of Patent: *Aug. 18, 2020**

(54) SELF-PROPELLED CONSTRUCTION MACHINE AND METHOD FOR OPERATING A SELF-PROPELLED CONSTRUCTION MACHINE

(71) Applicant: Wirtgen GmbH, Windhagen (DE)

(72) Inventors: Christian Berning, Zülpich (DE); Rene' Müller, Vettelschoß (DE); Sebastian Hofrath, Hennef (DE); Cyrus Barimani, Königswinter (DE)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/528,285

(22) Filed: Jul. 31, 2019

(65) Prior Publication Data

US 2020/0024812 A1 Jan. 23, 2020

Related U.S. Application Data

(63) Continuation of application No. 15/428,177, filed on Feb. 9, 2017, now Pat. No. 10,370,803.

(30) Foreign Application Priority Data

Feb. 16, 2016 (DE) ..... 10 2016 001 720

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ... E01C 23/0993; E01C 23/088; E01C 23/127
(Continued)

(56) References Cited

U.S. PATENT DOCUMENTS 8,386,196 B2 2/2013 Wagner et al.
8,775,099 B2 7/2014 Wagner et al.
(Continued)

FOREIGN PATENT DOCUMENTS

DE 102008045470 A1 3/2010
DE 102014015661 A1 4/2015
DE 102013112973 A1 5/2015

OTHER PUBLICATIONS

European Search Report in corresponding European Application No. EP 17 15 6134 dated Jun. 21, 2017, 9 pp. (not prior art).

*Primary Examiner* — Janine M Kreck
*Assistant Examiner* — Michael A Goodwin
(74) *Attorney, Agent, or Firm* — Lucian Wayne Beavers; Gary L. Montle; Patterson Intellectual Property Law, PC

(57) ABSTRACT

The invention relates to a self-propelled construction machine, comprising a machine frame supported by a chassis having wheels or crawler tracks. The basic principle of the invention involves determining a variable Δ which is characteristic of the milling profile on the basis of a functional relationship between the variable which is characteristic of the milling profile and the advance speed v and/or milling drum rotational speed n. The variable Δ which is characteristic of the milling profile is a correction variable for adjusting the height of the milling drum with respect to the surface of the ground.

19 Claims, 7 Drawing Sheets

(58) Field of Classification Search
USPC ..... 701/50
See application file for complete search history.

(56) References Cited

U.S. PATENT DOCUMENTS

| | | | | |
|---|---|---|---|---|
| 9,103,079 | B2 | 8/2015 | Schlenker et al. | |
| 2007/0150148 | A1 | 6/2007 | Rasmussen | |
| 2008/0173740 | A1 | 7/2008 | Parker et al. | |
| 2013/0140870 | A1 | 6/2013 | Johnson | |
| 2013/0162003 | A1 | 6/2013 | Killion | |
| 2014/0097665 | A1* | 4/2014 | Paulsen ..... | G01B 11/00 299/39.4 |
| 2015/0086268 | A1 | 3/2015 | Johnson et al. | |
| 2016/0258119 | A1 | 9/2016 | Krolnik et al. | |
| 2016/0340843 | A1 | 11/2016 | Laclef et al. | |

* cited by examiner

SELF-PROPELLED CONSTRUCTION MACHINE AND METHOD FOR OPERATING A SELF-PROPELLED CONSTRUCTION MACHINE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of German patent application number DE 10 2016 001 720.1, filed Feb. 16, 2016, and which is hereby incorporated by reference.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The invention relates to a self-propelled construction machine which has a machine frame supported by a chassis having wheels or crawler tracks.

In road construction, self-propelled construction machines having various constructions are used. These machines include the known road milling machines, by means of which existing road layers of the road pavement can be removed. The known recyclers are provided to remove existing road layers, to mix the removed milled material with binders such as bitumen, and thus to produce prepared mixed material suitable for reconstruction. Furthermore, surface miners are known as self-propelled construction machines, by means of which coal or ore can be broken down, for example.

The aforementioned construction machines have a rotating milling drum which is equipped with suitable milling or cutting tools for machining the ground. The milling drum is arranged on the machine frame, the height of which can be adjusted with respect to the ground to be machined. The height of the machine frame is adjusted by means of a lifting device, which has lifting columns associated with the individual wheels or crawler tracks. In addition, height adjustment of the milling drum relative to the machine frame may be provided.

In order to drive the wheels or crawler tracks and the milling drum, the construction machines comprise a drive device, which generally comprises only one drive unit, the drive power of which is transmitted to the wheels or crawler tracks and to the milling drum using separate drive trains, each of which may have their own transmission systems.

Further, the known construction machines may have a control and processing unit, by means of which the drive device and the lifting device are controlled. The control and processing unit controls the drive device in such a way that the construction machine moves in the terrain at a particular advance speed, the milling drum rotating at a particular milling drum rotational speed. Further, the control and processing unit controls the lifting device in such a way that a particular height of the milling drum with respect to the ground is set.

DE 10 2014 015 661 A1 describes a milling machine which comprises a milling drum housing having a milling drum. The milling machine has a sensor for recording the advance speed, a sensor for recording the height of the milling drum with respect to the surface of the ground, and a sensor for recording a physical variable which is characteristic of the ground to be machined, for example the density of the ground. The signals from the sensors are evaluated by a control apparatus, which is configured in such a way that a target advance speed and a target height for the milling drum are determined and set. The basic principle of the control is that the ground composition is taken into account when determining the target advance speed and the target height. This is advantageous in particular if the construction machine is a rotational mixer, which is described in DE 10 2014 015 661 A1.

DE 10 2008 045 470 A1 discloses a device for recording the current state of wear of the milling tools.

In the known construction machines, the machine driver can specify the advance speed and the rotational speed of the milling drum, as well as the milling depth, to be within particular limits depending on the particular operating conditions. The advance speed of the construction machine and the milling drum rotational speed determine the composition of the milled terrain surface, referred to as a milling result. The milling result or milling profile is also dependent on the use of the particular type of milling drum and milling or cutting tools. The individual types of milling drum differ in cutting circle diameter and in the configuration and arrangement of the milling or cutting tools.

At the start of the milling operations when the construction machine is stationary, the machine driver lowers the milling drum with respect to the surface of the ground until the milling or cutting tools are just touching the surface of the ground. At this moment, the milling depth is zero, in other words the milling drum is not yet milling off any material from the ground. The levelling device for setting the height of the milling drum with respect to the surface of the ground can thus be calibrated.

When milling operations are carried out, the intention is to achieve a particular operation result, which generally correlates with a desired milling depth to which the ground material is to be removed. After the levelling device is calibrated, a milling depth corresponding to this desired milling depth is therefore specified. For this purpose, the milling drum is lowered with respect to the surface of the ground until the lower edge of the cutting circle of the milling drum is positioned below the surface of the ground by the value of the specified milling depth.

When the construction machine moves in the terrain at a particular advance speed after the milling depth has been set, whilst the milling drum rotates at a particular milling drum rotational speed, a particular milling profile is produced on the basis of these variables. On the basis of the features of this milling profile, it may occur in practice that, under the particular constraints on the project, an actual milling depth occurs which deviates from the milling depth specified for a stationary machine and therefore does not correspond to the desired milling depth. In order for the actual milling depth to correspond to the desired milling depth, the machine driver therefore has to carry out a manual correction to the specified milling depth. In practice, the machine driver lowers the milling drum slightly.

BRIEF SUMMARY OF THE INVENTION

An object of the invention is to provide a self-propelled construction machine which allows for optimum adjustment of the milling depth under a wide range of constraints on the project. A further object of the invention is to simplify the operation of the construction machine. Another object of the invention is to provide a method for operating a construction machine, which allows for optimum adjustment of the milling depth under the wide range of constraints and simplifies operation of the construction machine.

The invention is based on the finding that the advance speed and/or the milling drum rotational speed are decisive as to the deviation of the actual milling depth from the specified milling depth. The specified milling depth, which is initially set by the machine driver at the start of the milling operations when the construction machine is still stationary, corresponds to a maximum milling depth, which is a result of the difference between the height of the surface of the ground and the height of the lower edge of the cutting circle of the milling drum. This maximum milling depth does not change when the construction machine is travelling in the terrain at a particular advance speed while the milling drum is rotating at a particular milling drum rotational speed. However, the milling result varies with the advance speed and the milling drum rotational speed. In practice, it is found that with an increasing advance speed or decreasing milling drum rotational speed, the roughness of the milled terrain surface increases. In section, the milled track has a particular profile which is characterised by maxima and minima, in other words points at which the milling depth is at a minimum or maximum.

A basic principle of the invention is that of configuring the control and processing unit in such a way that a variable which is characteristic of the milling profile is determined on the basis of a functional relationship between the variable which is characteristic of the milling profile and the advance speed and/or the milling drum rotational speed. The variable which is characteristic of the milling profile is a variable indicative of the composition of the ground surface. In practice, in the advance direction of the construction machine, the milling profile displays a sequence of elevations and depressions, the maximum milling depth being the vertical distance between the original terrain surface and the lowest point on the milled surface, and the minimum milling depth being the vertical distance between the original terrain surface and the highest point on the milled surface.

The variable which is characteristic of the milling profile may be an absolute or a relative value, for example the roughness of the surface or the deviation of an actual milling depth from a set milling depth. The variable which is characteristic of the milling profile may also be a variable which is already of interest in its own right, for example as a correction variable for the volume when billing for the milling operations. All that is essential is that this characteristic variable is determined on the basis of the advance speed and/or of the milling drum rotational speed.

The functional relationship between the variable which is characteristic of the milling profile and the advance speed and/or milling drum rotational speed can be described using a mathematical function. The coefficients of this mathematical function may also be determined empirically by tests. If the mathematical function is stored in the control and processing unit, the value of the characteristic variable can be calculated in a simple manner using the known coefficients. However, the functional relationship may also be stored in the control and processing unit in the form of a table in which specific characteristic values are assigned to the individual advance speeds and/or milling drum rotational speeds. The characteristic values stored in the table can be determined empirically. The relevant characteristic value may for example be read from a memory of the control and processing unit.

The control and processing unit may be part of a central control and processing unit of the construction machine, by means of which all the assemblies and components of the machine are controlled. However, it is also possible for the control and processing unit to be a separate unit which cooperates with other control and processing units. Thus, a control and processing unit means any unit by means of which the relevant operations can be carried out, for example a microcontroller or computer on which a data processing program (software) runs.

For the milling profile, in particular the ratio of the advance speed to the milling drum rotational speed is of decisive importance. An embodiment of the construction machine according to the invention and the method according to the invention for operating the construction machine therefore provides that the variable which is characteristic of the milling profile is determined on the basis of a functional relationship between the variable which is characteristic of the milling profile and the ratio of the advance speed and the milling drum rotational speed.

An embodiment provides that the variable which is characteristic of the milling profile is a correction variable for a predetermined milling depth, the control and processing unit being configured in such a way that, instead of the specified milling depth, a value that is corrected using the correction variable is set for the milling depth. This results in an automatic correction to the effect that, irrespective of the advance speed of the construction machine and/or the rotational speed of the milling drum, the actual milling depth always corresponds to a desired milling depth. In this case, the actual milling depth may be a milling depth which can be set differently with a view to the milling profile. For example, the actual milling depth may be a milling depth which corresponds to the maxima or minima or to an average between the maxima and minima of the milling profile.

In an embodiment, the correction variable is the vertical distance between a point on the milling profile at which the milling depth is a minimum and a point on the milling profile at which the milling depth is a maximum. The control and processing unit is configured in such a way that, in order to correct the milling depth, the milling drum is lowered by the magnitude of this correction variable. This provides that material is milled away, in the operating direction, to a particular level below the terrain surface over the entire milled track, in other words no material remains in the milled track above this level. In this embodiment, the actual milling depth corresponds to a milling depth which extends as far as the minima of the milling profile.

The control and processing unit may preferably be configured in such a way that the value for the milling depth, which value is corrected using the correction variable, is compared with a specified threshold value, a control signal being generated if the threshold value is exceeded or undershot. Preferably, an alarm unit connected to the control and processing unit may be provided, and is designed in such a way that an acoustic and/or optical alarm is emitted when the alarm unit receives the control signal from the control and processing unit.

A particular embodiment provides the following configuration of the control and processing unit: In order to set the predetermined milling depth, the control and processing unit is configured in such a way that, when the construction machine is stationary, the milling drum is lowered from a first position, in which the lower edge of the cutting circle of the milling drum is at the level of the surface of the ground, into a second position such that the lower edge of the cutting circle of the milling drum is at a distance from the level of the surface of the ground that corresponds to the specified milling depth. At this moment, the advance speed of the construction machine is zero. In this connection, a first and second position are not necessarily understood to mean positions assumed in immediate succession. Rather, the milling drum may also assume further positions between these two positions.

When the advance speed is zero, a correction is not required. The correction is only intended to begin when the construction machine sets off, in other words when the advance speed is greater than zero. After the construction machine sets off, instead of the specified milling depth, a value is continuously set for the milling depth, which value is corrected using the correction variable and is dependent on the advance speed or on the advance speed and the rotational speed of the milling drum in such a way that the actual milling depth corresponds to the desired milling depth. When the construction machine comes to a halt, in other words the advance speed is zero again, there is again no correction. As a result, irrespective of the advance speed and the milling drum rotational speed, in particular when the construction machine sets off and comes to a halt, a substantially constant actual milling depth and a substantially uniform milling profile are achieved over the milled track in the operating direction.

The variable which is characteristic of the milling profile may be displayed on a display unit. The display unit may have any form, for example being a display, which may be part of a central display unit of the construction machine. The variable which is characteristic of the milling profile may also be read from a memory of the control and processing unit.

The machine driver may specify the milling depth, for example on an input unit. The control and processing unit is subsequently configured such that the level of the milling drum is set so that, without any correction to the milling depth, the lower edge of the cutting circle is positioned below the surface of the ground by the value of the specified milling depth.

In another embodiment, the current state of wear of the milling tools is taken into account when correcting the milling depth. When the milling tools become worn, the vertical distance between the lowest point of the milled surface and the original terrain surface changes in accordance with the depth of wear of the milling tools. This means that the maximum milling depth no longer corresponds to the set milling depth. It may therefore be provided that the state of wear of the tools is recorded automatically or manually and taken into account in the control and processing unit when determining the correction value. This ensures that the levelling device does not have to be recalibrated for worn milling tools.

BRIEF DESCRIPTION OF THE SEVERAL VIEWS OF THE DRAWINGS

In the following, an embodiment of the invention will be described in detail with reference to the drawings, in which.

DETAILED DESCRIPTION OF THE INVENTION

Figure 1:
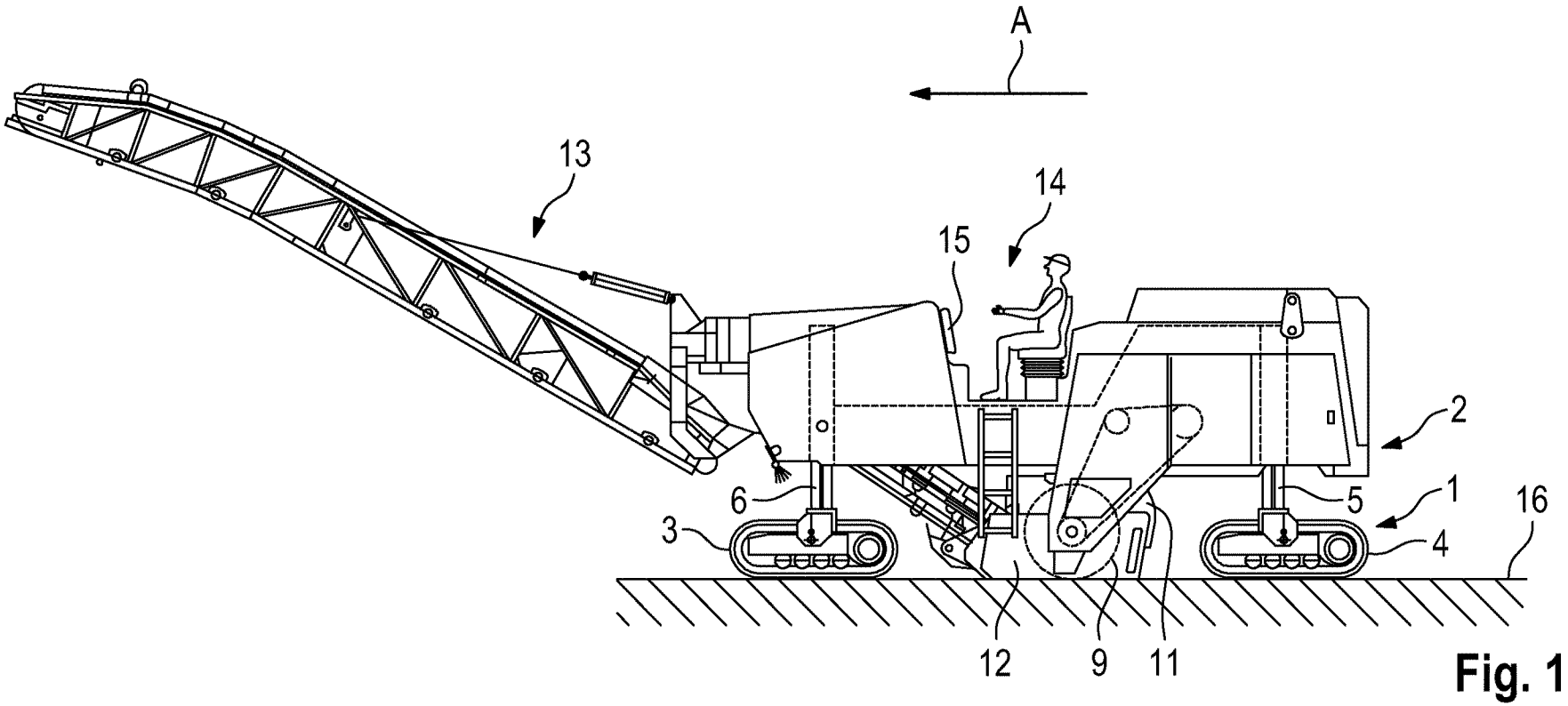
FIG. 1 is a side view of a road milling machine as an example of a self-propelled construction machine.
Figure 2:
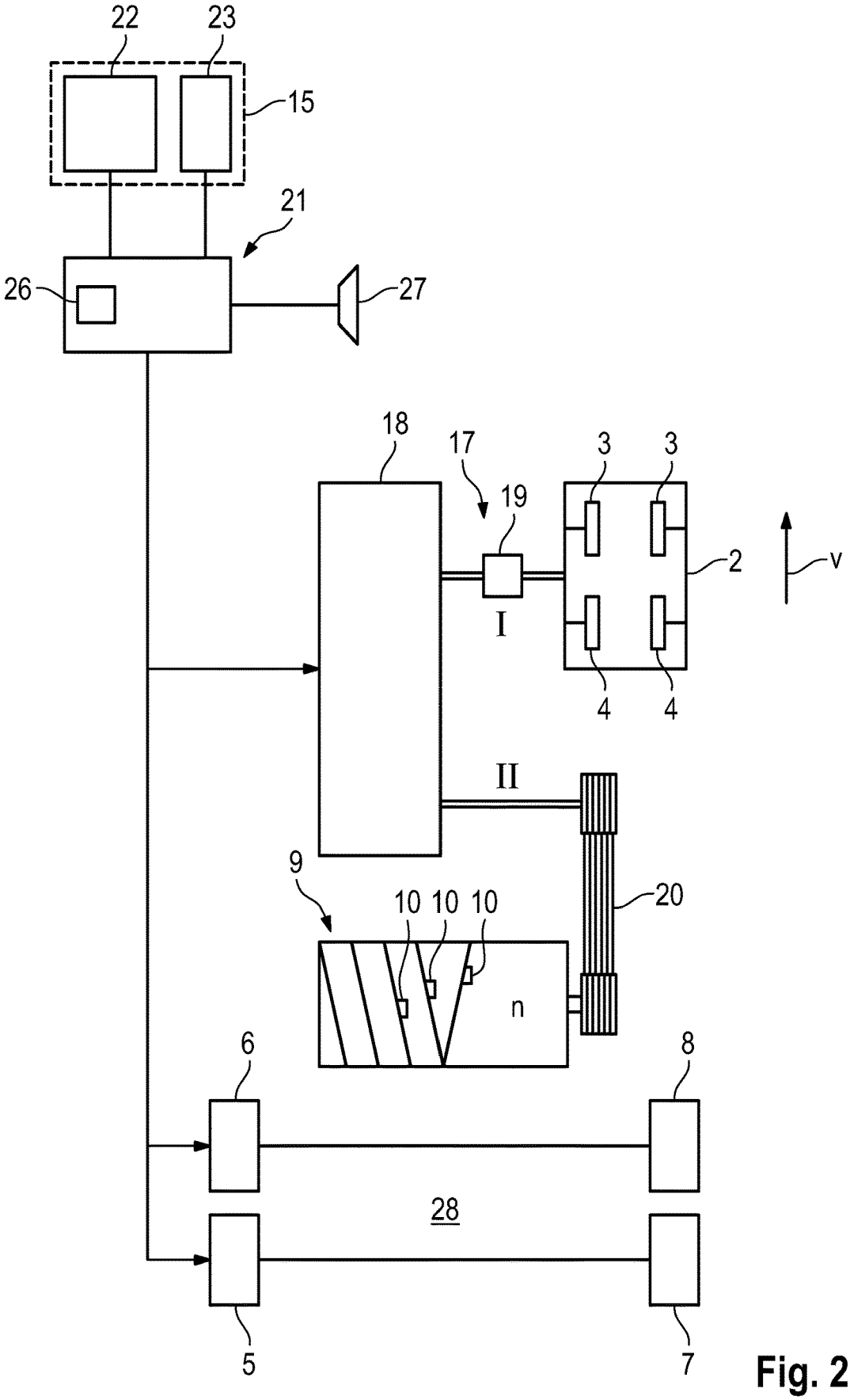
FIG. 2 is a highly simplified schematic view of the assemblies of the construction machine which are essential to the invention.

FIG. 1 shows a road milling machine for milling road surfaces made of asphalt, concrete or the like as an example of a self-propelled construction machine. FIG. 2 is a highly simplified schematic view of the assemblies of the construction machine which are essential to the invention. The construction machine according to the invention may, for example, be a road milling machine or a surface miner.

The road milling machine comprises a machine frame 2 supported by a chassis 1. The chassis 1 of the milling machine comprises front and rear crawler tracks 3, 4, which are arranged on the right and left side of the machine frame 2 when viewed in the operating direction A. Wheels may also be provided instead of crawler tracks.

To adjust the height of the machine frame with respect to the surface 16 of the ground, the self-propelled construction machine comprises a lifting device 28 which comprises lifting columns 5, 6, 7, 8 which are associated with the individual crawler tracks 3, 4 and by which the machine frame 2 is supported (FIGS. 1 and 2).

The construction machine has a milling drum 9, which is equipped with milling tools 10, for example milling picks. The milling drum 9 is arranged on the machine frame 2 between the front and rear crawler tracks 3, 4 in a milling drum housing 11 that is closed off at the longitudinal sides by an edge protector 12, at the front by a hold-down device (not shown), and at the rear by a wiping device (not shown). The milled material which is milled off is transported away by a conveying device 13. The driver's cab 14, comprising a control panel 15 for the machine driver, is located on the machine frame 2, above the milling drum housing 11.

By retracting and extending the lifting columns 5, 6, 7, 8 of the lifting device 28, the height of the milling drum 9 can be adjusted with respect to the surface 16 of the ground.

In order to drive the crawler tracks 3, 4 and to drive the milling drum 9 and further assemblies, the construction machine has a drive device 17, which has an internal combustion engine 18. A first drive train I is used to transmit the drive power of the internal combustion engine 18 to the crawler tracks 3, 4, whilst a second drive train II is used to transmit the drive power to the milling drum 9. The first drive train I may comprise a hydraulic transmission system 19 and the second drive train II may comprise a chain and rope drive 20. Drive systems of this type are known to a person skilled in the art.

In order to control the drive device 17 and the lifting device 28 and further assemblies, the construction machine comprises a preferably central control and processing unit 21, by means of which the crawler tracks 3, 4 are actuated in such a way that the construction machine moves in the operating direction A at a predetermined advance speed v and the milling drum 9 rotates at a specified milling drum rotational speed n. The control and processing unit 21 also actuates the lifting columns 5, 6, 7, 8 in such a way that the machine frame 2 is raised and lowered together with the milling drum 9 in order to set the desired milling depth h.

The control panel 15 of the construction machine comprises an input unit 22 and a display unit 23. On the input unit 22, for example a touchscreen, the machine driver can input a particular advance speed v, a particular milling drum rotational speed n and a milling depth h, the control and processing unit 21 actuating the drive device 17 in such a way that the construction machine moves at the advance speed v specified by the machine driver and the milling drum 9 rotates at the specified milling drum rotational speed n, and actuates the lifting device 28 in such a way that the specified milling depth h is set.

Figure 3A:
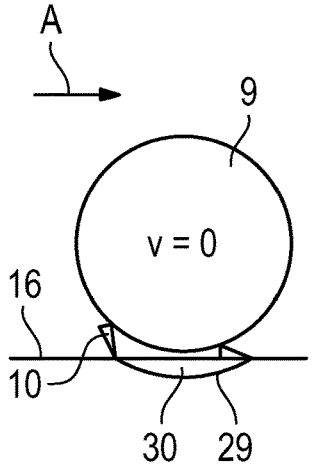
FIG. 3A to 3B are highly simplified schematic views of the milling drum equipped with milling picks for different advance speeds.
Figure 3B:
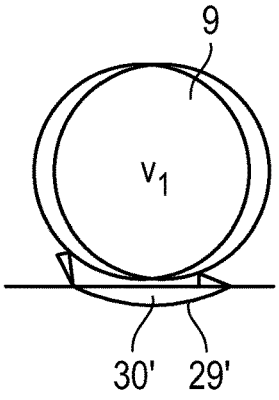
Figure 3C:
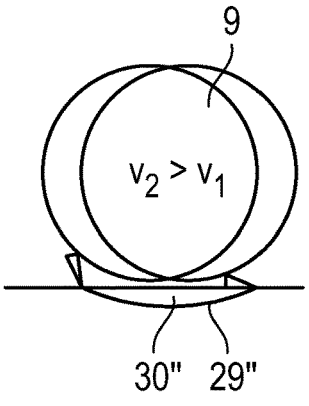

FIG. 3A to 3C are highly simplified schematic views of the milling drum 9, which is equipped with milling picks 10, only one milling pick being shown in the drawings. Whilst the milling drum 9 rotates at the specified rotational speed n, the construction machine moves in the operating direction A at the specified advance speed v. The drawings show the line on which the tip of the milling pick 10 moves, the milling drum rotational speed n being constant. FIG. 3A shows the cutting line 29 when the construction machine is stationary, FIG. 3B shows the cutting line 29' when the construction machine is moving at an advance speed v1, and FIG. 3C shows the cutting line 29" when the construction machine is moving at an advance speed v2, where v2>v1. A trough 30, 30', 30" in the terrain surface 16 is shown.

Figure 4A:
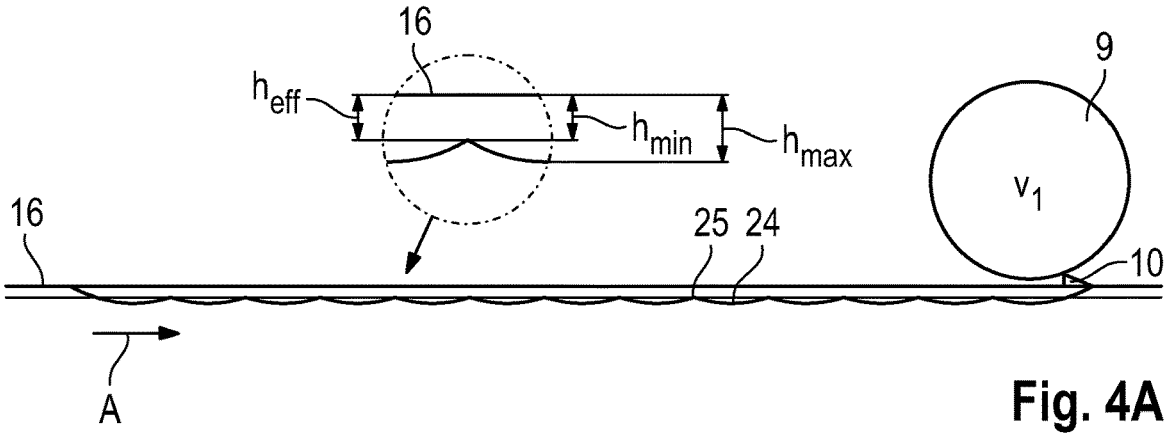
FIGS. 4A and 4B are sections through the milled terrain for different advance speeds of the construction machine.
Figure 4B:
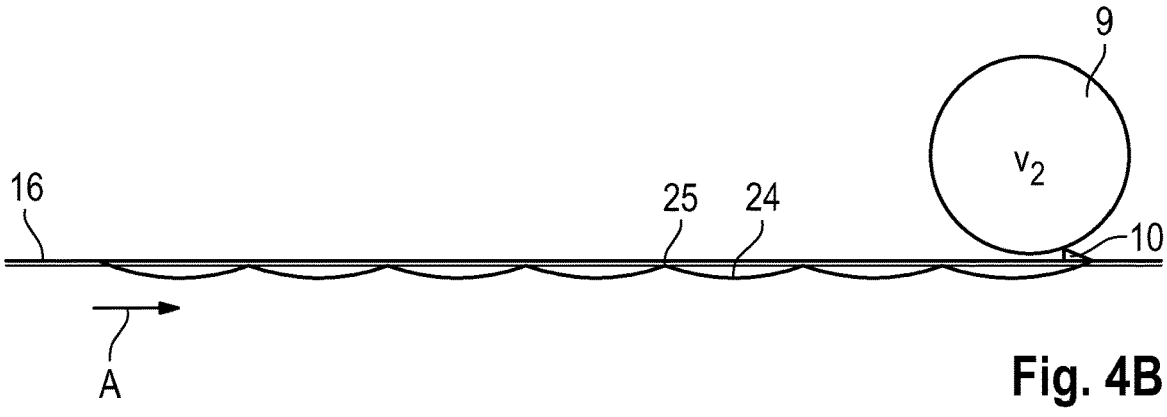

FIG. 4A and FIG. 4B are sections through the milled terrain at different advance speeds v1 and v2 of the construction machine, resulting in different milling profiles (v2>v1). The two milling profiles share the continuous sequence of depressions 24 and elevations 25 in the operating direction A of the construction machine, resulting in a certain degree of roughness of the terrain surface.

FIGS. 4A and 4B show that the height of the elevations 25 is dependent on the advance speed v1 or v2. A faster advance speed v2 results in higher elevations 25 than a slower advance speed v1. The milling profile is characterized by "maxima" and "minima", in other words points at which the milling depth is smallest and points at which the milling depth is greatest. The vertical distance between the surface 16 of the original terrain and the point at which the milling depth is smallest thus defines a minimum milling depth $h_{min}$, and the vertical distance between the surface 16 of the terrain and the point at which the milling depth is greatest thus defines a maximum milling depth $h_{max}$, which corresponds to the specified milling depth h. It is found that the maximum milling depth $h_{max}$ is independent of the advance speed v. However, the minimum milling depth $h_{min}$ is found to be dependent on the advance speed v.

Figure 5A:
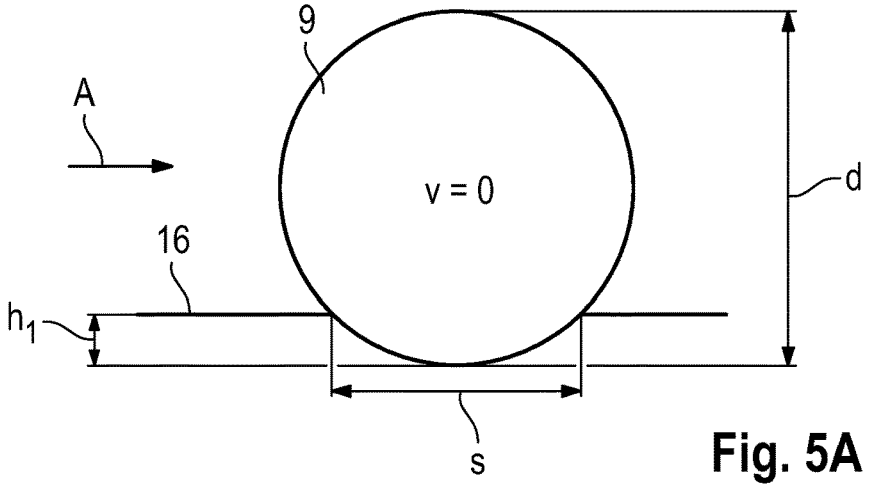
FIG. 5A to 5C are enlarged views of the cutting circle of the milling drum, the construction machine being moved at different advance speeds and a relatively deep milling depth being set.
Figure 5B:
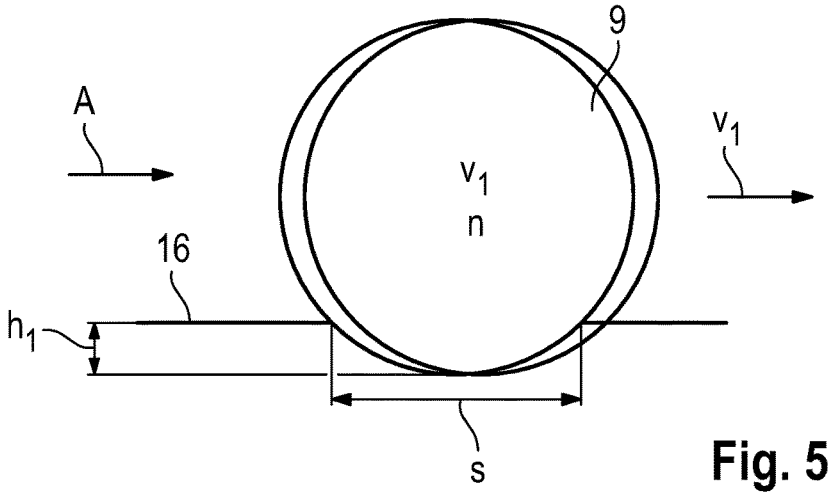
Figure 5C:
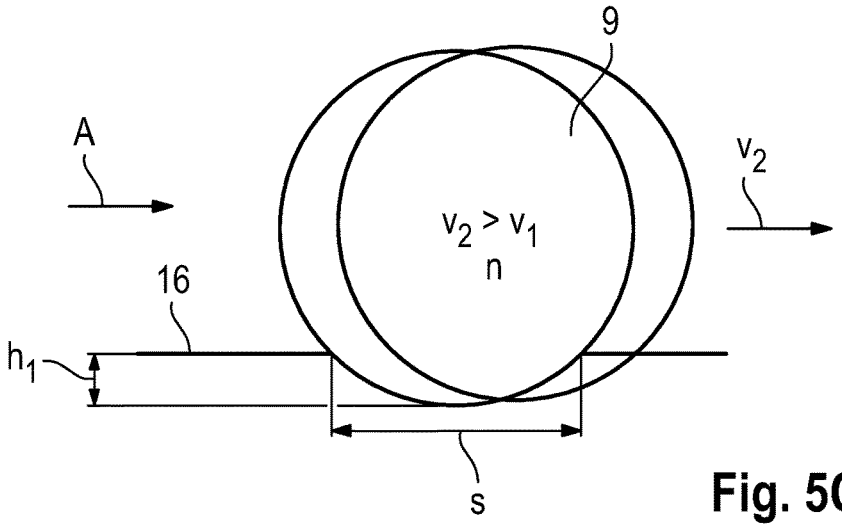

FIG. 5A to 5C are enlarged views of the cutting circle of the milling drum 9, the construction machine moving at different advance speeds v1 and v2 and the milling drum rotational speed n being constant. In the embodiment, it is assumed that the milling drum 9 has a cutting circle diameter d of 1020 mm and that a milling depth h1 of 10 mm is set. The milling drum rotational speed n is 100 rpm. The length of the cut in the milling direction A when v=0 is shown as s. This results in a cut length s of approximately 201 mm (h=h1). In general, the cut length s is calculated as follows:

$$s-2\sqrt{dh-h^2}$$

FIG. 5A shows the stationary milling drum 9. FIG. 5B shows the milling drum moving in the milling direction at an advance speed v1 of 2 m/min, and FIG. 5C shows the milling drum moving in the milling direction at an advance speed v2 of 5 m/min. FIG. 5B shows that, at the advance speed v1, the milling drum moves a distance in the milling direction A corresponding to approximately 1/10 s during a rotation, in other words approximately 20 mm/rotation. FIG. 5C shows that, at the advance speed v2, the milling drum moves a distance in the milling direction A corresponding to approximately ¼ s during a rotation, in other words approximately 50 mm/rotation.

Figure 6A:
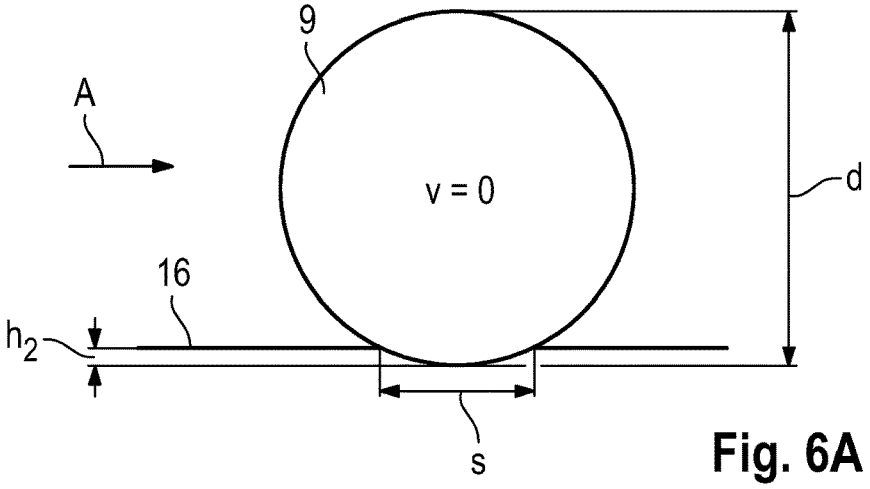
FIG. 6A to 6C are enlarged views of the cutting circle of the milling drum, the construction machine being moved at different advance speeds and a relatively shallow milling depth being set.
Figure 6B:
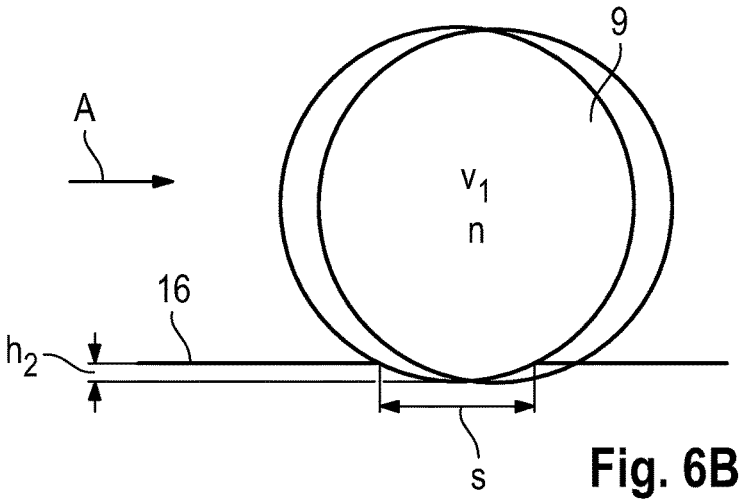
Figure 6C:
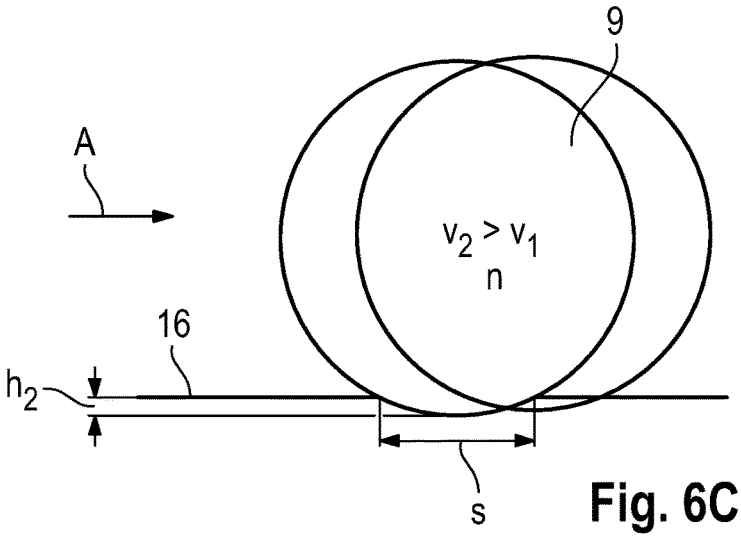

FIG. 6A to 6C show an embodiment in which the milling drum 9 has the same cutting circle diameter d of 1020 mm, but a milling depth h2 of 3 mm is set. The milling drum rotational speed n is once again 100 rpm. The cut length is approximately 101 mm. FIG. 6A shows the stationary milling drum. FIG. 6B shows the milling drum moving in the milling direction at an advance speed v1 of 2 m/min, and FIG. 6C shows the milling drum moving in the milling direction at an advance speed v2 of 5 m/min. FIG. 6B shows that, at the advance speed v1, the milling drum moves a distance in the milling direction corresponding to approximately ⅕ s during a rotation, in other words approximately 20 mm/rotation. FIG. 6C shows that, at the advance speed v2, the milling drum moves a distance in the milling direction corresponding to approximately ½ s during a rotation, in other words approximately 50 mm/rotation.

Figure 7:
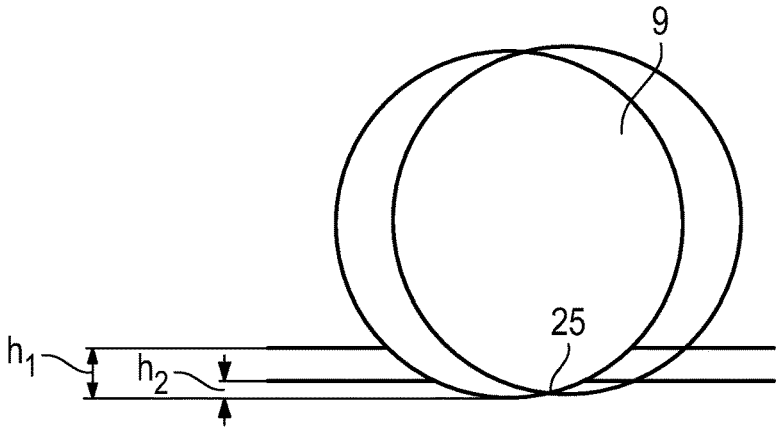
FIG. 7 is a sectional view showing the height of the elevations in relation to the milling depth.

Although the height of the elevations 25 is identical for both embodiments, it can be seen from FIG. 7 that, in relation to the maximum milling depth $h_{max}$, the elevations 25 are greater in the second embodiment at the smaller milling depth than in the first embodiment at the greater milling depth.

The milling drums 9 have a plurality of milling picks 10 which are arranged around the circumference of the milling drum and are axially offset from one another, each milling pick producing a cutting line in a particular time interval. This thus results in a cutting profile characterized by a plurality of cutting lines shifted with respect to one another.

Figure 8A:
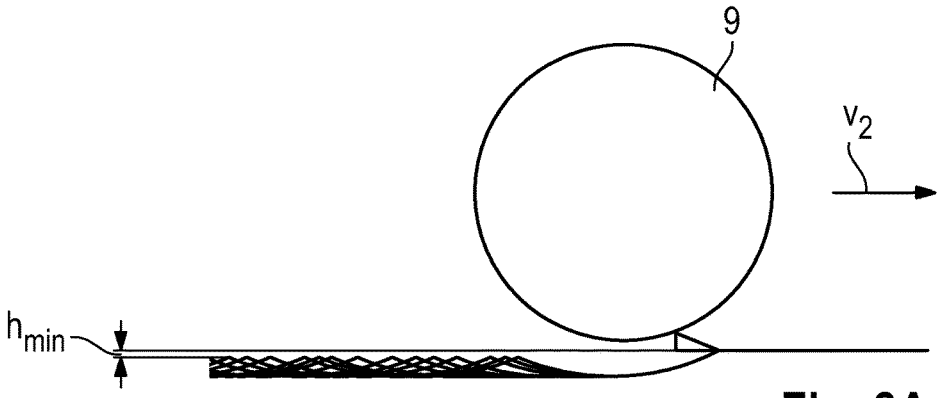
FIGS. 8A and 8B are sectional views, composed of individual cutting lines, for a faster advance speed and for a slower advance speed.
Figure 8B:
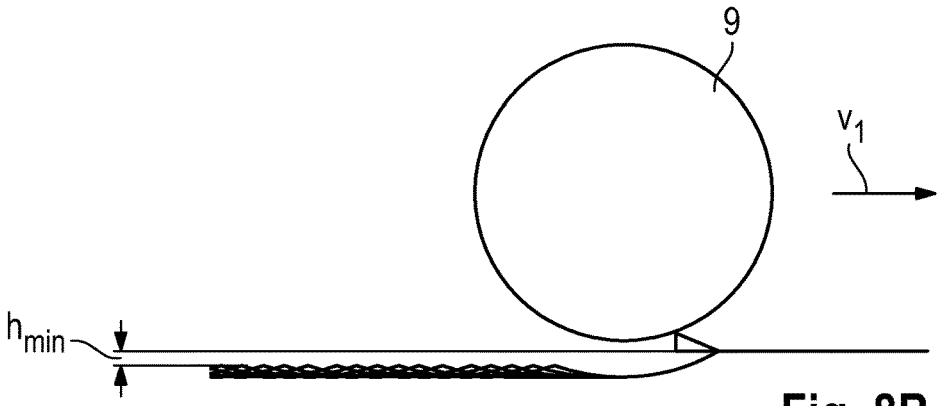

FIG. 8A shows the cutting profile composed of the individual cutting lines for a faster advance speed v2, and FIG. 8B shows said cutting profile for a slower advance speed v1. Again, a minimum and maximum milling depth $h_{min}$, $h_{max}$ are shown, the minimum milling depth $h_{min}$, being dependent on the advance speed v and the milling drum rotational speed n. It can clearly be seen that at a faster advance speed v2, the minimum milling depth $h_{min}$ is smaller than at a slower advance speed v.

If for example an operating result is desired in which, above a particular level, no more material remains in the milled track, the milling depth has to be corrected in such a way that the minimum milling depth $h_{min}$ corresponds to the desired milling depth. The actual milling depth $h_{eff}$ is thus equal to the minimum milling depth $h_{min}$.

In the following, the control and processing unit of the construction machine according to the invention is described in detail.

Figure 9:
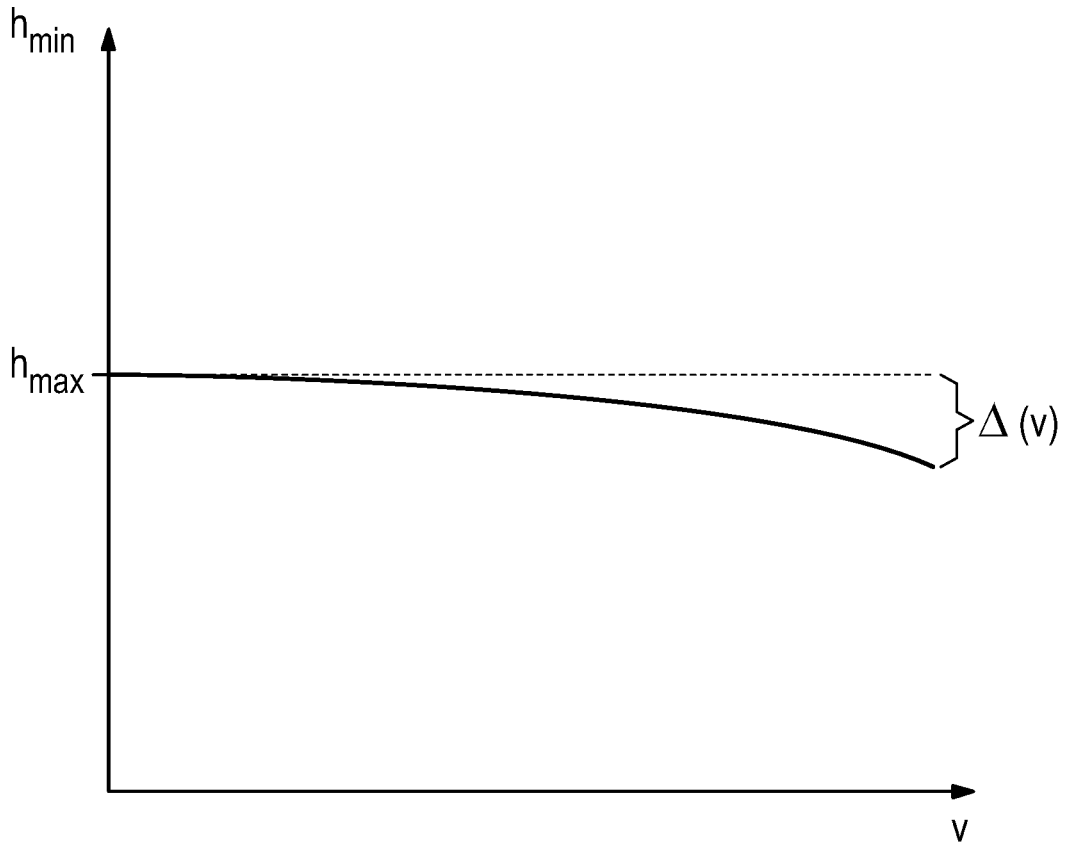
FIG. 9 shows the functional correlation between a value which is characteristic of the milling profile and the ratio of the advance speed to the milling drum rotational speed.

For a constant milling drum rotational speed n, FIG. 9 shows the dependency of the minimum milling depth $h_{min}$ on the ratio of the advance speed v to the milling drum rotational speed n. At an advance speed of zero, the minimum milling depth $h_{min}$ corresponds to the maximum milling depth $h_{max}$, in other words no elevations 25 or depressions 24 are found since the milling drum has dug into the ground vertically. As the advance speed v increases, the minimum milling depth $h_{min}$ continuously decreases since the height of the elevations continuously increases.

$$h_{max}=h_{min}+\Delta(v)$$

The deviation Δ(v) of the minimum milling depth $h_{min}$ from the maximum milling depth $h_{max}$, in other words the magnitude of the difference between the minimum milling depth $h_{min}$ and the maximum milling depth $h_{max}$, is calculated using the following equation:

$$\Delta = \frac{d}{2} - \frac{1}{2}\sqrt{d^2 - x^2}$$

where x=advance speed v [mm/min]/milling drum rotational speed n [rpm].

For example, for an advance speed of v=5 m/min and a rotational speed of n=100 rpm, in accordance with the above equation, a milling drum 9 having a cutting circle diameter of d=1020 mm results in a deviation Δ(v) of approximately 0.6 mm.

FIG. 9 merely shows the dependency of the milling depth h on the advance speed v. However, the milling depth h is also dependent on the milling drum rotational speed n. The minimum milling depth $h_{min}$ decreases as the milling drum rotational speed n decreases. The milling depth h is in particular dependent on the ratio of the advance speed to the milling drum rotational speed v/n. Doubling the milling drum rotational speed has the same effect on the change in the milling depth as halving the advance speed.

The milling depth h is also dependent on the particular type of milling drum. Different types of milling drum which have the same cutting circle diameter d may for example differ in the number of milling picks. For example, two milling picks arranged on a line instead of one milling pick have the same effect on the change in milling depth h as halving the advance speed or doubling the milling drum rotational speed.

In the present embodiment, the deviation Δ(v, n) of the minimum milling depth $h_{min}$ from the maximum milling depth $h_{max}$ is the variable which is characteristic of the milling profile. In the present embodiment, this variable is used as a correction value for controlling the milling depth. However, a variable derived from the deviation Δ(v, n) of the minimum milling depth $h_{min}$ from the maximum milling depth $h_{max}$ may also be used as the correction variable, for example the deviation Δ(v, n) of a value between the minimum milling depth $h_{min}$ and maximum milling depth $h_{max}$ from the maximum milling depth $h_{max}$. The value between the minimum milling depth $h_{min}$ and the maximum milling depth $h_{max}$ can specify an average milling depth, the desired milling depth corresponding to an average milling depth.

The control and processing unit 21 may be a data processing unit, on which a data processing program (software) runs so as to carry out the method steps described below.

The control and processing unit 21 comprises a memory 26, in which, for different types of milling drum which differ in the cutting circle diameter d and the number and arrangement and design of the milling picks 10, the above-disclosed functional relationship between the deviation Δ(v, n) of the minimum milling depth $h_{min}$ from the maximum milling depth $h_{max}$ and the advance speed v and the milling drum rotational speed n or the ratio of the advance speed to the milling drum rotational speed v/n are stored in the form of the coefficients of a mathematical function or in the form of a table of values. The advance speed v and the milling drum rotational speed n are known to the control and processing unit 21 when these values are input into the input unit 22 by the machine driver. However, the advance speed v and/or the milling drum rotational speed n can also be measured continuously. Sensors suitable for this purpose exist in the art.

During operation of the construction machine, the control and processing unit 21 continuously determines the correction variable Δ(v, n) for a particular milling drum type at a specified or measured advance speed v and milling drum rotational speed n.

On the basis of the known functional relationship, the correction variable Δ(v, n) can be calculated according to the above equation and/or read from a memory 26 of the control and processing unit 21 as an empirically determined value. This correction variable changes continuously when the advance speed v and/or milling drum rotational speed n change.

The value of the correction variable or a value derived therefrom can be displayed to the machine driver on the control panel 15 on the display unit 23. The value may also be read from the memory 26 of the control and processing unit 21. Interfaces suitable for this purpose exist in the art.

The correction to the setting of the milling depth, known as automatic milling depth regulation, is described in the following.

While the construction machine is stationary, the machine driver lowers the milling drum 9 manually until the tips of the milling pick 10 just touch the surface 16 of the ground. At this moment, the control and processing unit 21 will specify a value of zero for the milling depth. The levelling device is thus calibrated.

The machine driver can input a value for a milling depth h on the input unit 22. This value is stored in the memory 26 of the control and processing unit 21.

The control and processing unit 21 reads the value for the milling depth h, specified by the machine driver, from the memory 26 and subsequently lowers the milling drum 9 while the construction machine is stationary until the specified milling depth h is set.

When the machine driver has set the construction machine in motion, the control and processing unit 21 actuates the drive device 21 in such a way that the construction machine moves in the operating direction A at the predetermined advance speed v, which can also be changed during the advancement, and the milling drum 9 rotates at the specified milling drum rotational speed n, which can also be changed during the advancement.

The control and processing unit 21 determines a correction value Δ(v, n), in other words the deviation of the minimum milling depth $h_{min}$ from the maximum milling depth $h_{max}$, for each advance speed v or milling drum rotational speed n, in particular for each ratio n/v of the advance speed v to the milling drum rotational speed n, the maximum milling depth $h_{max}$ being the milling depth specified when the construction machine is stationary. The milling drum is subsequently lowered by the correction value, with respect to the height specified when the machine is stationary, as the construction machine advances.

When the construction machine sets off, the milling drum is lowered since the advance speed increases as the machine accelerates. When the construction machine is moving at a constant advance speed v, and with a constant milling drum rotational speed, no further correction takes place. By contrast, when the advance speed v and/or the milling drum rotational speed changes, correction takes place continuously. When the construction machine comes to a halt, the milling drum is raised again since the advance speed decreases when the machine is braked, and therefore the correction value by which the milling drum is being lowered also decreases.

One embodiment provides that the control and processing unit 21 is configured in such a way that the value for the milling depth, which value is corrected using the correction variable, is compared with a specified threshold value, a control signal being generated if the threshold value is exceeded or undershot. The construction machine comprises an alarm unit 27, which is connected to the control and processing unit 21 and may be arranged on the control panel 15. When the alarm unit 27 receives the signal from the control and processing unit 21, it generates an optical and/or acoustic alarm. For example, a threshold value $h_{limit}$ for the current maximum milling depth $h_{max}$ resulting after the correction may be specified as the threshold value. A threshold value of this type may for example be specified if material is to be prevented from being removed in a region located below a particular level or if a greater milling depth is not to be adjusted in relation to the advance speed v and/or milling drum rotational speed n.

The control and processing unit may be configured in such a way that, if a threshold value is exceeded, the milling depth is not corrected. When a threshold value is exceeded, the alarm can prompt the machine driver to intervene in the machine control.

If in practice it were necessary to lower the milling drum 9 further to correct the milling depth, but a threshold value for a maximum milling depth is not to be exceeded, the alarm indicates to the machine driver that, in order to resolve this conflict, the advance speed v is intended to be reduced and/or the milling drum rotational speed n is intended to be increased. However, the control and processing unit 21 according to the invention may also be formed in such a way that in this situation the advance speed v is reduced and/or the milling drum rotational speed n is increased automatically.

If the milling tools become worn, the vertical distance between the lowest point of the milled surface and the original terrain surface changes in accordance with the depth of wear of the milling tools. When the milling depth is corrected, the current state of wear of the milling tools may be taken into account. For this purpose, the state of wear of the tools is recorded automatically using a suitable measurement value sensor or is input manually. The control and processing unit is configured in such a way that the wear of the milling tools is taken into account when determining the correction value.

What is claimed is:

1. A method for operating a self-propelled construction machine having a milling drum for machining the ground, a particular advance speed, at which the construction machine moves in the terrain, a particular milling drum rotational speed, at which the milling drum rotates, and a particular height of the milling drum with respect to a surface of the ground to be machined being adjustable such that material is removed from the ground, the method comprising:

determining a variable which is characteristic of a milling profile, based at least in part on the advance speed and/or the milling drum rotational speed;

determining a correction variable for a specified milling depth, based at least in part on the variable which is characteristic of the milling profile; and adjusting the height of the milling drum based on the correction variable.

2. The method of claim 1, wherein the correction variable is the variable which is characteristic of the milling profile.

3. The method of claim 2, wherein the correction variable is a vertical distance between a point on the milling profile at which the milling depth is a minimum and a point on the milling profile at which the milling depth is a maximum.

4. The method of claim 1, wherein the correction variable is derived from the variable which is characteristic of the milling profile.

5. The method of claim 4, wherein:

the variable which is characteristic of the milling profile is a vertical distance between a point on the milling profile at which the milling depth is a minimum and a point on the milling profile at which the milling depth is a maximum, and the correction variable is a deviation of a value between the minimum milling depth and the maximum milling depth from the maximum milling depth.

6. The method of claim 1, wherein the variable which is characteristic of the milling profile is determined on the basis of a functional relationship between the variable which is characteristic of the milling profile and a ratio of the advance speed to the milling drum rotational speed.

7. The method of claim 1, wherein the height of the milling drum is adjusted by a magnitude of the correction variable.

8. The method of claim 1, wherein the specified milling depth, which value is corrected using the correction variable, is compared with a specified threshold value, a control signal being generated if the threshold value is exceeded or undershot.

9. The method of claim 8, wherein an acoustic and/or optical alarm is emitted from an alarm unit upon receiving the control signal.

10. The method of claim 1, wherein a current state of wear of one or more milling tools is taken into account when determining the variable which is characteristic of the milling profile.

11. The method of claim 10, further comprising automatically recording the current state of wear of the one or more milling tools via a measurement value sensor.

12. The method of claim 1, wherein in order to set the specified milling depth, the milling drum is lowered from a first position, in which a lower edge of a cutting circle of the milling drum is at the level of the surface of the ground, into a second position when the construction machine is stationary such that the lower edge of the cutting circle of the milling drum is at a distance from the level of the surface of the ground that corresponds to the specified milling depth, and wherein after the construction machine sets off, instead of the specified milling depth, a value that is corrected using the correction value is continuously set for the milling depth.

13. A method for operating a self-propelled construction machine having a milling drum for machining the ground, the height of which drum is adjustable with respect to a surface of the ground to be machined such that material is removed from the ground, the method comprising:

when the construction machine is stationary, lowering the milling drum from a first position, wherein a lower edge of a cutting circle of the milling drum is at the level of the surface of the ground, into a second position wherein the lower edge of the cutting circle of the milling drum is at a distance from the level of the surface of the ground corresponding to a specified milling depth; and during an advance of the construction machine, determining a variable which is characteristic of a milling profile, based at least in part on an advance speed and/or a milling drum rotational speed, determining a correction variable for the specified milling depth, based at least in part on the variable which is characteristic of the milling profile, and instead of the specified milling depth, a value that is corrected using the correction variable is continuously set for the milling depth.

14. The method of claim 13, wherein the correction variable is the variable which is characteristic of the milling profile.

15. The method of claim 14, wherein the correction variable is a vertical distance between a point on the milling profile at which the milling depth is a minimum and a point on the milling profile at which the milling depth is a maximum.

16. The method of claim 15, wherein:

the value that is corrected using the correction variable is a deviation of a value between the minimum milling depth and the maximum milling depth from the maximum milling depth.

17. The method of claim 13, wherein the variable which is characteristic of the milling profile is determined on the basis of a functional relationship between the variable which is characteristic of the milling profile and a ratio of the advance speed to the milling drum rotational speed.

18. The method of claim 13, wherein the height of the milling drum is adjusted by a magnitude of the correction variable.

19. The method of claim 13, wherein the specified milling depth, which value is corrected using the correction variable, is compared with a specified threshold value, a control signal being generated if the threshold value is exceeded or undershot.

* * * * *